US006140620A

United States Patent [19]

Aldridge et al.

[11] Patent Number: 6,140,620

[45] Date of Patent: Oct. 31, 2000

[54] APPLIANCE TIMER

[76] Inventors: James E. Aldridge, 211D Seacrest Dr., Wrightsvile Beach, N.C. 28480; Carol F. Stewart, 2414 Carbonton Dr., Sanford, N.C. 27330

[21] Appl. No.: 09/282,090

[22] Filed: Mar. 30, 1999

[51] Int. Cl.[7] ..... H05B 1/02

[52] U.S. Cl. ..... 219/493; 219/492; 219/481; 219/506; 219/519; 219/414; 307/117

[58] Field of Search ..... 219/492, 493, 219/497, 506, 519, 481, 411–414; 307/117

[56] References Cited

U.S. PATENT DOCUMENTS

| | | | |
|---|---|---|---|
| 3,824,374 | 7/1974 | Mayher | 219/510 |
| 4,222,037 | 9/1980 | Schaap et al. . | |
| 4,705,930 | 11/1987 | Sathre, Jr. et al. | 219/492 |
| 5,046,157 | 9/1991 | Smith et al. . | |
| 5,073,701 | 12/1991 | Ljunggren . | |
| 5,097,113 | 3/1992 | Aoyama . | |
| 5,289,158 | 2/1994 | Neves . | |
| 5,416,301 | 5/1995 | Aoshima . | |
| 5,693,245 | 12/1997 | Clizbe | 219/492 |

*Primary Examiner*—Mark Paschall
*Attorney, Agent, or Firm*—Rhodes & Mason, PLLC

[57] ABSTRACT

A device for disconnecting an electric appliance or a component thereof from a source of electricity including a circuit connecting the appliance or component thereof to a power source through a relay or other component to open the circuit; and a timer circuit connected to the relay. The timer circuit includes a processor for setting the timer circuit, and a manually operated switch in communication with the processor. The timer circuit is activated for a predetermined time increment by closing the switch, and the relay is closed while the timer circuit is activated. When the switch is closed again while the timer circuit is activated, an additional time increment is added to the activation period.

16 Claims, 5 Drawing Sheets

U1
DUAL SEVEN SEG
COM2
COM1
A1 A2 B1 B2 C1 C2 D1 D2 E1 E2 F1 F2 G1 G2 DP1 DP2
Q3
2N3904
Q1
2N3904
R12
2.2k
R10
2.2k 330 x 7
R3 thru R9
S1
SWITCH BAR
C2
.01uf
+5V
R1
12k
U2
MC68HRC705KJ1
reset osc1 osc2 pb3 pb2 Vdd Vss pa7
irq pa0 pa1 pa2 pa3 pa4 pa5 pa6
C1
.01uf
R2
100k
C4
.01uf
C3
10uf
C5
.01uf
R11
2.2k
Q2
2N3904
U3
7805
IN OUT GND
C7
.01uf
C6
.01uf
J1
CONNECTOR TO RELAY BOX

APPLIANCE TIMER

BACKGROUND OF THE INVENTION (1) Field of the Invention

The present invention relates generally to a device for controlling appliances, such as electric stoves or ranges, and in particular to a device for automatically disconnecting the appliance from the source of electrical current after a preset period of time.

(2) Description of the Prior Art

Electrical heating appliances, especially stoves or ranges, can create a fire hazard if inadvertently left on after use. To address this concern, it has been proposed to include an audible alarm that is activated after a preset time period, alerting the user to the need to turn off the appliance. Such alarms are useless, however, when the user is not within hearing distance.

U.S. Pat. No. 5,289,158 to Neves describes a device for automatically disconnecting power to a range if the range is left on for a predetermined period of time at a predetermined power level. The Neves device is comprised of a sensing box that is electrically connected to a display and control box. The sensing box is designed to be plugged into an electrical receptacle with the range being plugged into the sensing box, while the control box is designed to be attached to a readily accessible part of the range, e.g. by a magnet.

The Neves sensing box includes means for sensing the level of current flowing to the range, a means timing the current flow, and disconnect means for opening the circuit is based upon a combination of current flow and time. The control box includes a signal means to indicate that the current has been disconnected, a reset button to restore power to the range, and an override switch to override the system if more time is required.

U.S. Pat. No. 5,073,701 to Ljunggren also recognizes the potential danger in failing to turn off ranges and other cooking appliances for an extended period of time. Ljunggren addresses this concern by using a detector to detect movement of a knob used to set the desired power level of a range. The detector is connected to a time counting arrangement or timer which, upon activation, counts up to a predetermined time. At the end of the predetermined time, a signal is generated to inactivate the electrical circuit. Touching of the knob during use automatically resets the timer.

Devices of the above types are useful in automatically turning off a range after a predetermined period of time, and thus minimizing the fire hazard. However, the period of time at which the range operates is not readily controllable by the operator. Also, there is no provision made for controlling the timing in a simple to operate manner that is easily performed by the elderly or physically handicapped. A device addressing these deficiencies in the prior art would result in considerable improvements in safety and convenience.

SUMMARY OF THE INVENTION

The present invention is directed to a device for automatically disconnecting a range from a power source after the expiration of one or more time periods, referred to herein as the activation period, manually set by the user during use of the range. The invention relates especially to a device of this type that permits the easy addition of time increments to the activation period, making the device especially useful by the elderly or physically handicapped.

In general, it has been found that the objectives of the present invention can be achieved by inserting a plug-in circuit breaker that includes a timer circuit between an electrical outlet and the range to control current flow, and controlling the period of time that the timer circuit is completed with a switch that adds a predetermined increment of time to the activation period each time the switch is touched. The switch, which can be in the form of a touch plate, can be positioned at a convenient place on the range where it will be readily accessible by the user.

To energize the circuit, the user simply touches the switch plate to add a predetermined increment of time, e.g., fifteen minutes, to the activation period. In its basic form, the switch plate will restart at the predetermined time increment each time the switch plate is touched. For example, if the predetermined time is fifteen minutes, the circuit will be energized for fifteen minutes when the plate is first touched. During the activation period, if additional time is desired, the plate can be touched again to return the cycle to the beginning of the predetermined, e.g., fifteen minute time period.

In a preferred embodiment of the invention, however, an additional increment of time is added to the activation period each time the switch is touched. For example, if the user wants the range to be activated for forty-five minutes, and the predetermined time is set at fifteen minutes, the user simply touches the switch plate three times. Similarly, if the user determines that additional time is need during the activation period, the switch plate can be touched again to add an additional predetermine time. For example, if the switch plate is touched twice at the beginning to set the activation period for thirty minutes, and the user decided when the activation period has five minutes left that additional time is required, the user simply touches the plate to increase the remaining time to twenty minutes, i.e. the remaining five minutes, plus the added fifteen minute increment. Thus, time increments, up to a predetermined maximum time, can be added to the cycle by simply touching the plate one or more additional times at the beginning of and during the cycle. At the expiration of the sum of the times incremented by touching the plate, the timer circuit disconnects the circuit to discontinue electrical current to the range or other appliance.

More particularly, the device of the present invention is comprised of an electrical circuit including an input plug connector to connect the circuit to an electrical outlet, an output plug connector to connect the circuit to the appliance, a relay positioned between the two connectors to control the flow of electricity from the input plug connector to the output plug connector, a timer circuit to control opening and closing of the relay, a timer activation switch to control the timer circuit, and wiring to join the other circuit components.

As used in the present invention, the term "relay" is intended to broadly include a device that is positioned within an electric circuit, and has an open position preventing current from flowing through the circuit, and a closed position permitting current to flow through the circuit. Depending upon the circuit configuration, the relay may be in the clod position when current is flowing though a second circuit to activate the relay, or in the closed position when no current is flowing through the second circuit.

The circuit may additionally contain a digital time display, a switch to manually open the circuit, a signal activated upon time expiration, and housings for the connector plug and the activation switch. Other known components, such as AC/DC transformers, are also included in the circuit for their known uses.

The input and output plug connectors are preferably located in a housing that is positionable between the electrical outlet and appliance. This housing may be constructed of a heat and electrically resistant plastic, Bakelite, or other known material. The input plug connector, including male connectors, may be positioned on one side of the housing, while the output plug connector, including female connectors, may be positioned on the opposite side of the housing.

The timer circuit may be a conventional timer circuit, such as a 555 timer integrated circuit, or a more sophisticated microprocessor. The timer circuit is actuated for a predetermined time upon temporarily closing a switch. Setting of the time period will depend on the type of processor used. With a 555 IC, the time period may be set in a known manner by capacitor and resistor selection. With microcontrollers, the time and other operational functions are determined by a one-time software program.

The predetermined time increment for the present invention is normally selected to be in the range of 5 to 30 minutes, with about 15 minutes being a preferred time increment. The timer circuit can also be designed for a maximum activation period of from, e.g., one to four hours, with three hours being a preferred maximum time setting.

The timer circuit is used to control a relay of conventional design that will normally be closed upon activation of the timer for the predetermined time period, allowing current to flow from the input connector to the output connector. At the completion of the time period, the relay opens.

The timer activation switch is an especially important aspect of the present invention enabling the elderly or physically handicapped to turn on the range for a desired activation period by simply touching the switch one or more times. At the same time the operator will not need to remember to turn the range off after use, since the circuit will be automatically opened at the end of the activation period.

The timer activation switch is generally comprised of a contact surface or plate that may be of various shapes, such as rectangular or circular. The overall dimension of the switch is not critical to the invention, although it should be of sufficient size to be easily contacted by frail or handicapped individuals. Momentary touching of the switch energizes the timer circuit for the predetermined timer period, with each additional touch restarting the cycle or, preferably, adding an additional time increment. Various types of switches may be used. However, for ease of operation, the switch is preferably of the resistive film or capacitive touch type, so that the switch is activated merely by the presence of the individual's finger, without pressure being required.

A time display is preferably connected to the timer circuit to enable the operator to determine the time remaining in the activation period. This display will normally be a two or three digit LED display, normally with a red cover for visibility. In addition, the circuit may include an alarm that is automatically activated for a brief time period at the end of the activation period.

In operation, the input plug connector is inserted into an electrical outlet, normally a 220 V wall outlet, and the appliance is connected with the output plug connector. The timer is activated by contacting the activation switch one or more times. The timer, in turn, closes a relay positioned between the two connectors to permit the flow of electricity to the appliance. During use, the operator can view the remaining time on the digital time display. If additional time is desired, the operator simply touches the activation switch to restart the cycle, or add another increment of time. The relay is opened at the expiration of the activation period determined by the sum of times the switch is closed multiplied by the predetermined time increment. The circuit can again be completed by touching the activation switch.

As noted above, the preferred circuit of the invention permits the addition of time increments to the activation period either at the beginning of the period or during the period, so that the activation period can be varied by predetermined increments up to a maximum time. Suitable circuitry for this purpose can be based upon a microcontroller that can be programmed to add time increments based on the number of times the switch is activated, e.g., touched.

Thus, the present invention can be comprised of a timer display unit, and a power supply to supply power to the timer/display unit and to the appliance. The timer/display unit can be comprised of a microcontroller operatively connected to a relay in the power unit to open and close the relay, thereby controlling power to the appliance. In addition, the timer/display unit includes a switch connected to the microcontroller for inputting activation signals, and a display for visually providing time information to the user.

The power supply is comprised of a first cord for connecting the supply to a wall outlet, a second cord for connecting the power supply to the appliance, and a relay connecting the two cords. When the relay is closed, current will flow from the wall outlet to the appliance. Additionally, an electrical connection joins the first power cord via a transformer to the microcontroller in the timer/display unit.

When the power unit is plugged into the wall, the microcontroller, such as an MC68HRC705KJ1 microcontroller, is programmed to execute an initialization algorithm to set the device for receipt of an input signal. During this initialization, all Port A and B pins are set to outputs, the relay drive circuit is turned off, the external interrupt input (IRQ), i.e., the switch input circuit, is set to edge-sensitive triggering, all random access memory (RAM) locations are set to zero, the LED display is set to "0", the internal timer interrupt is initialized and enabled, and the Watchdog Timer is initialized and enabled.

After the initialization algorithm has been completed, the microcontroller watches for an initial switch input. If the switch input is detected, the microcontroller debounces the switch input to insure a legal switch push has occurred and not a noise spike, turns on the relay drive output, adds a predetermined lime increment to the LED display, resets the Watchdog timer to inhibit reset, waits for the switch to be released, and counts the timer down toward "0". When a one-minute time period has elapsed, decrements the LIED display by one minute.

If another switch push is recognized, the Microcontroller adds an additional time increment corresponding to the predetermined time. When the timer counts down to "0", the microcontroller turns off the relay drive output, resets the Watchdog timer, and waits for further switch input.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
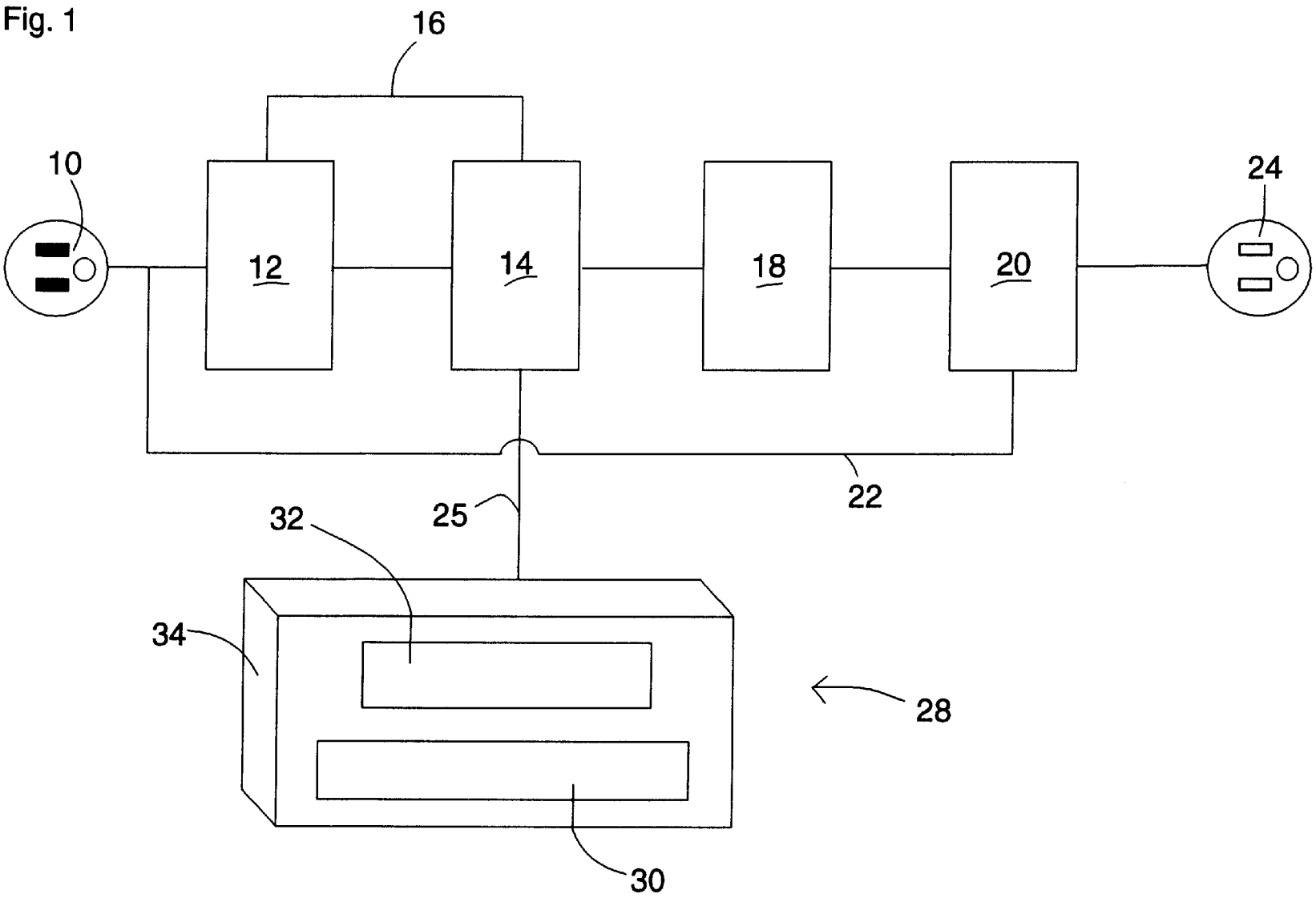
FIG. 1 is a block diagram of one representative circuit.

FIG. 1 illustrates a simple device in which the activation period is set to a predetermined time when the switch is activated, e.g., touched, and reset to the predetermined time if the switch is activated during the activation period. This device is comprised of an input plug connector 10 to connect the circuit to a 220 V AC electrical outlet. Current entering the circuit is transformed to 12 V DC by transformer 12 to power timer 14, passing via wiring 16. Timer 14, in turn, is used to control relay 18, used to control power relay 20. AC current is carried by wiring 22 through power relay 20 to output connector 24 suitable for attaching ranges and other appliances.

Timer 14 is controlled via wiring 26 by a control box, generally 28, which includes a resistance touch switch 30 to input time increments to timer 14, and a digital time display 32, so that the operator can determine the time remaining. Switch 30 and display 32 are enclosed in housing 34, which may include an attachment means (not shown) for securing box 28 at a readily accessible location.

Figure 2:
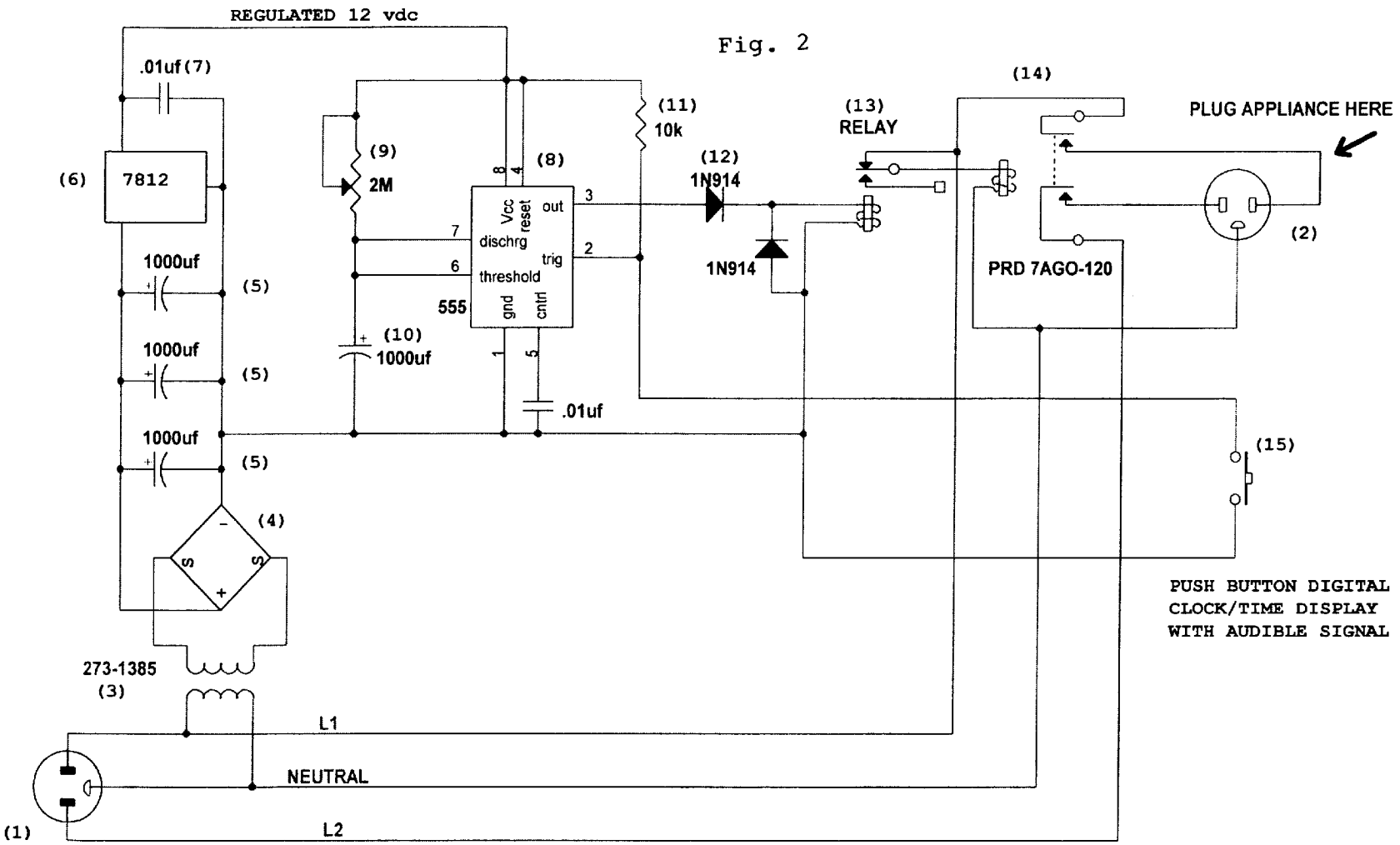
FIG. 2 is a schematic of a simple electrical circuit suitable for purposes of the present invention when incremental time additions are not required.

FIG. 2 illustrates one of several electrical circuits useful in practicing the present invention in which the activation period is reset by touching the switch. As shown, an input plug is connected to a 220 V AC outlet and an output plug is connected to a range or other appliance. Primary transformer 273–1385 steps down 120 V AC flowing through L1, and neutral to 12 V AC, which is converted by full wave rectifier 276–1146 to pulsating DC, and smoothed by capacitors and regulator 7812 before flowing to pin #8 of a 555 timer integrated circuit, the response time of which is controlled by a capacitor and a potentiometer.

Output from the 555 timer, rectified by the IN914 diode, engages a primary relay. When activated, the primary relay applies 120 V AC across power relay PRD 7AG0–120 to the appliance receptacle. Activation of the 555 timer is via a resistance switch, which may be touched one or more times to determine the time period for range operation.

Figure 3:
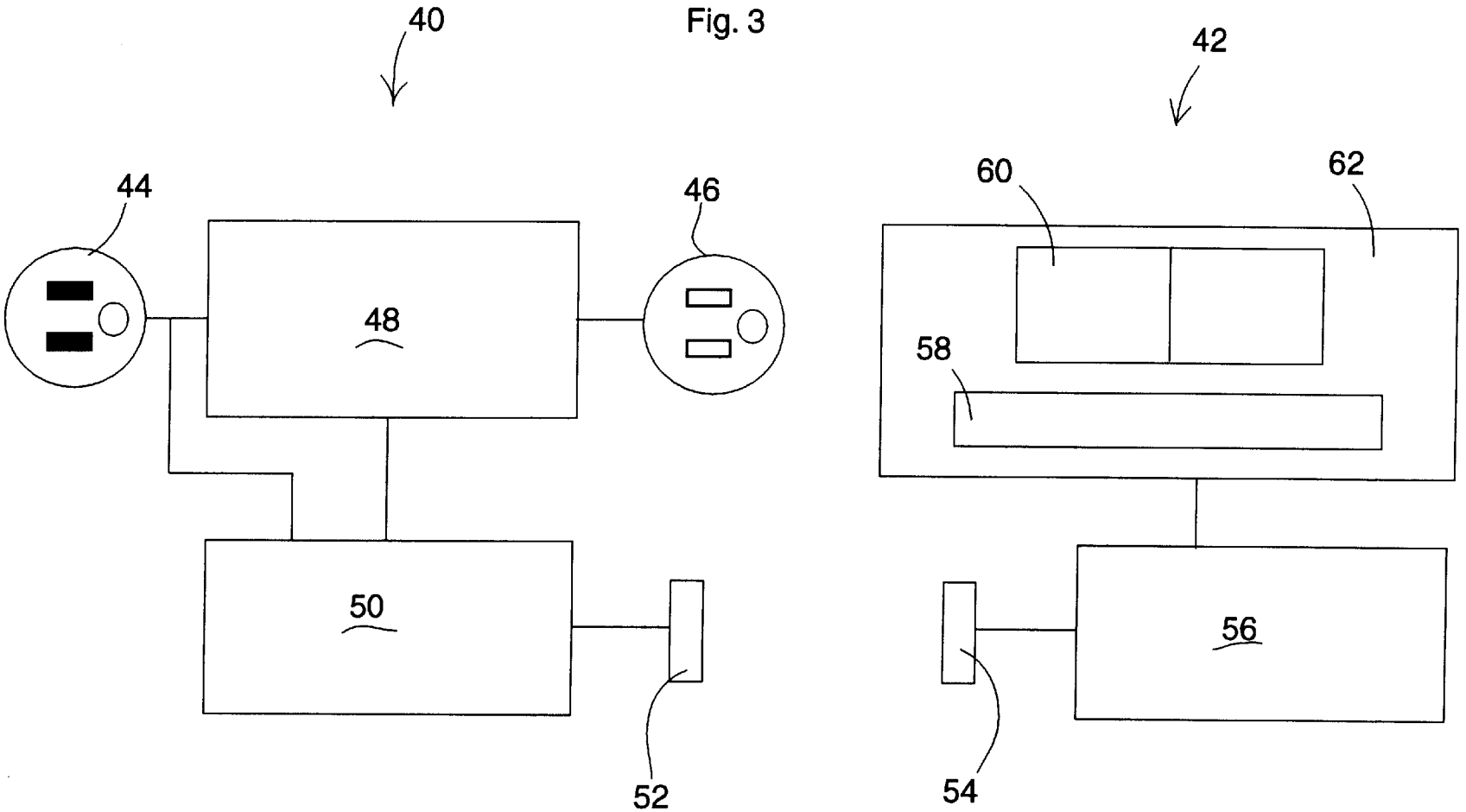
FIG. 3 is a block diagram of another representative circuit.
Figure 4:
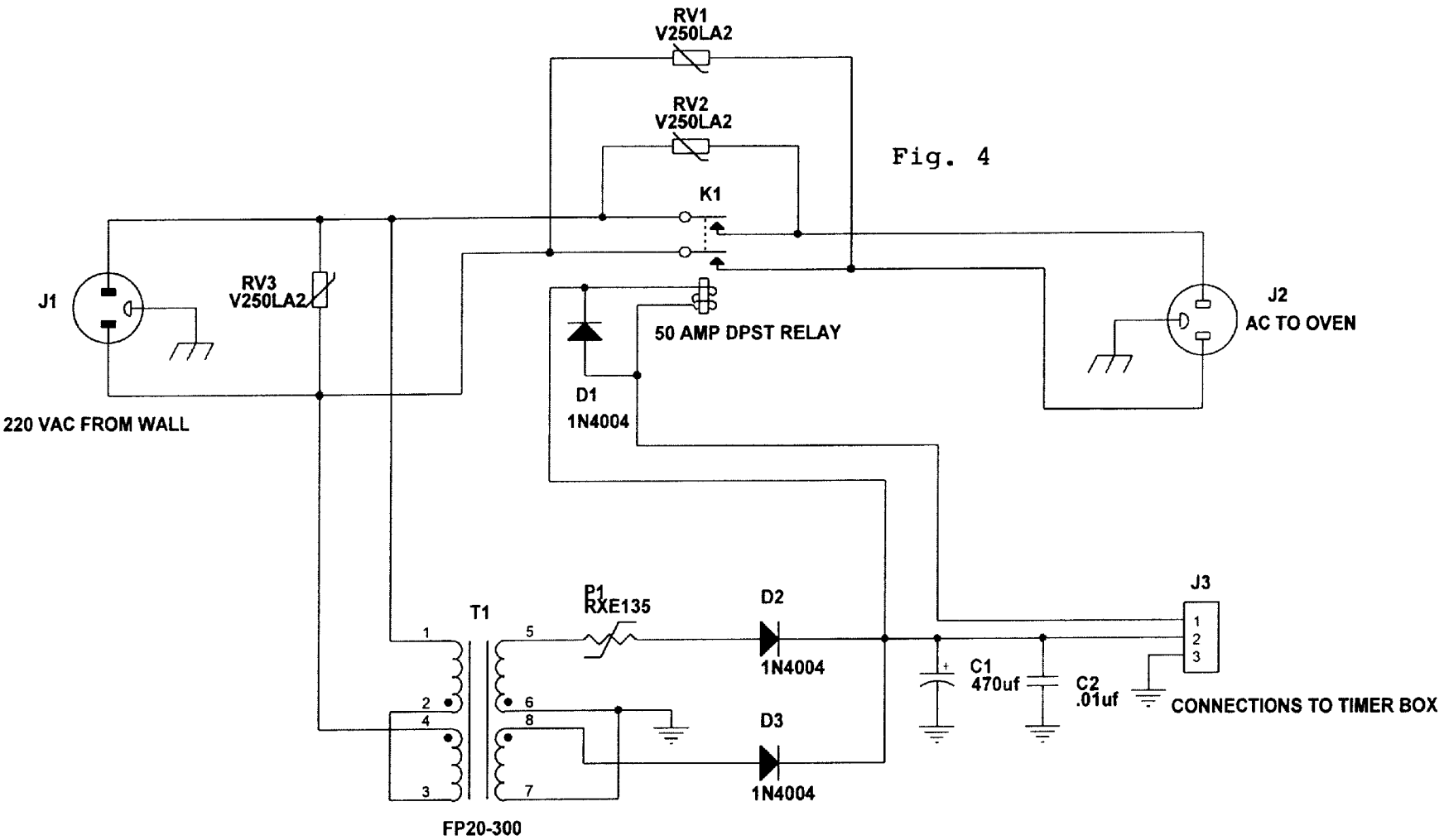
FIG. 4 is a schematic of an electrical relay circuit suitable for providing power to the appliance and the timer/display circuit of FIG. 5.
Figure 5:
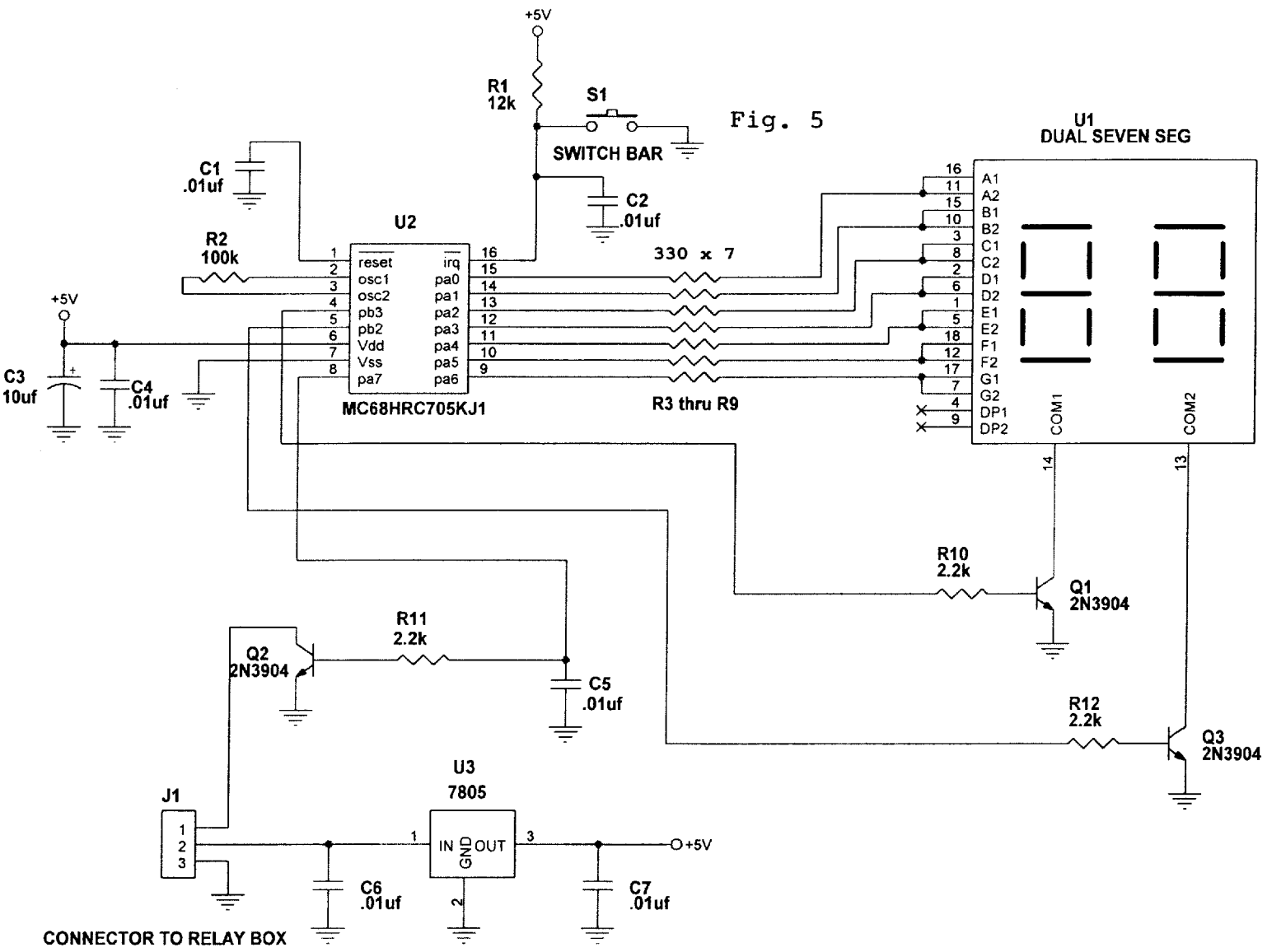
FIG. 5 is a schematic of a timer display circuit permitting the addition of additional time segments to the appliance operation time during operation.

FIG. 3 illustrated an embodiment of the invention in which the operational or activation period is additive, i.e., determined by the number of times the switch is closed times the predetermined time period. As shown in the illustration, the device is comprised of a power supply, generally 40, which connects to a timer/display unit, generally 42. Power supply 40 is comprised of a first connector 44 for plugging power supply 40 into a 220 V wall outlet, a second connector 46 for attaching power supply 40 to an appliance, and a relay 48 permitting current to flow between said connectors 44 and 46 when relay 48 is in a closed position. A transformer 50 receives power directly from the 220 V source and provides 12 V power to operate relay 48.

Transformer 50 also connects through connectors 52 and 54 to microprocessor 56, which is connected to switch 58, and an LED display 60. For purposes of illustration, switch 58 and display 60 are shown within housing 62, while microprocessor 56 is shown outside housing 62. In the commercial unit, microprocessor 56 will also be located in housing 62.

In operation, connector 44 is plugged into a wall outlet, providing power to one side of relay 48, and to transformer 50. Transformer 50 then powers relay 48 and microcontroller 56. When switch 58 is closed, microcontroller 56 adds a predetermined time increment, e.g., fifteen minutes, to display 60, and signals transformer 50 to power relay 48, thereby closing relay 48 to close the circuit from the power source to the appliance.

At each one-minute increment, microcontroller 56 reduces the time displayed by one minute. If switch 58 is closed during the initial predetermined time increment, microcontroller 56 adds an additional time increment to the display. When all of the time has expired, microcontroller 56 signals transformer 50 to discontinue power to relay 48, thereby opening the circuit to the appliance.

Thus, in accordance with the present invention, the user of an appliance needs only to touch a switch, such as a resistance or capacitance switch to connect an appliance, such as a range or stove, to a power source, with the length of time during which the appliance is connected being dependent upon the number of times the switch is closed. At the end of the activation period, the appliance is automatically disconnected from the power source, thus eliminating the risk of fire due to the burners, oven, or other heating component being inadvertently left on after use.

While the invention has been described in terms of a unit that can be used to modify an existing appliance, it will also be apparent that the invention is applicable to the modification of electric ranges and other appliances that include a heating element at the time the appliance is manufactured. In those instances, the timer/display unit can be connected to a power circuit that is positioned between the appliance and the power source or between the heating element to be disconnected and the power source. As used in the present invention, it will be understood that, in those instances, the appliance is intended to mean the heating element to be disconnected, and not necessarily other components of the appliance.

Certain modifications and improvements will occur to those skilled in the art upon a reading of the foregoing description. It should be understood that all such modifications and improvements have been deleted herein for the sake of conciseness and readability but are properly within the scope of the invention.

What is claimed is:

1. A device for connecting at least the heating element of an electric appliance to a source of electricity comprising:

a) a power circuit between said heating element and said source of electricity, said power circuit having a closed position in which said appliance heating element is connected to said source of electricity and an open position in which said heating element is disconnected from said source of electricity; and b) a timer circuit connected to said power circuit, said timer circuit including a manually closable switch, said timer circuit being activated for an activation period equal to the number of times the switch is closed multiplied by a predetermined time, and said power circuit being in the closed position while said timer circuit is activated.

2. The device of claim 1, wherein said power circuit includes a relay that is opened and closed by said timer circuit.

3. The device of claim 1, wherein said timer circuit further include a display for visually showing the remaining time of the activation period.

4. The device of claim 1, wherein said heating element is part of an electric range.

5. The device of claim 1, wherein said timer circuit is enclosed in a housing.

6. The device of claim 1, wherein said switch is a resistance or capacitance switch.

7. A device for connecting an electric appliance or a component thereof to a source of electricity comprising:

a) a power supply including a first connector for attaching the power supply to a power source, a second connector for attaching the power supply to said component, and a relay permitting current to flow between said first and said second connectors when said relay is in a closed position; and b) a timer circuit connected to said relay, said timer circuit including a processor for setting the timer circuit, and a manually closable switch in communication with said processor, said timer circuit being activated by closing said switch for a time equal to the number of times the switch is closed multiplied by a predetermined time, and said relay being closed when said timer circuit is activated.

8. The device of claim 7, wherein said timer circuit further include a display for visually showing the remaining time of the activation period.

9. The device of claim 7, wherein said appliance is an electric range.

10. The device of claim 7, wherein said timer circuit is enclosed in a housing.

11. The device of claim 7, wherein said switch is a resistance or capacitance switch.

12. A method of connecting an electric appliance or a component thereof to a source of electricity comprising:

a) providing a relay joined by a first connector to a power source, and by a second connector to said component, said relay having a closed position permitting current to flow from said power source to said component;

b) providing a timer circuit connected to said relay, said timer circuit including a processor for setting the timer circuit, and a manually closable switch in communication with said processor, said timer circuit being activated by closing said switch for a time equal to the number of times the switch is closed multiplied by a predetermined time, and said relay being closed when said timer circuit is activated; and c) closing said switch at least one time to close said relay.

13. The method of claim 12, wherein said switch is closed a plurality of times to provide a total operating time equal to the number of times the switch is closed multiplied by said predetermined time increment.

14. The method of claim 12, further including the step of visually displaying the remaining operating time.

15. The method of claim 12, wherein said switch is a resistance or capacitance switch.

16. The method of claim 12, wherein said appliance is an electric range having a power cord for connecting said range to a source of electricity, said relay being positioned between said power cord and said source of electricity.

* * * * *